US006654975B2

(12) United States Patent
Broker

(10) Patent No.: US 6,654,975 B2
(45) Date of Patent: Dec. 2, 2003

(54) APPLIANCE INCORPORATING LEVELING DISPLAY SYSTEM

(75) Inventor: John F. Broker, Colfax, IA (US)

(73) Assignee: Maytag Corporation, Newton, IA (US)

( * ) Notice: Subject to any disclaimer, the term of this patent is extended or adjusted under 35 U.S.C. 154(b) by 292 days.

(21) Appl. No.: 09/935,708

(22) Filed: Aug. 24, 2001

(65) Prior Publication Data

US 2003/0037383 A1 Feb. 27, 2003

(51) Int. Cl.[7] ..... D06F 33/02

(52) U.S. Cl. ..... 8/159; 68/12.02; 68/12.06; 68/12.27

(58) Field of Search ..... 8/159; 68/12.02, 68/12.06, 12.12, 12.27

(56) References Cited

U.S. PATENT DOCUMENTS

| | | | | |
|---|---|---|---|---|
| 3,088,593 A | | 5/1963 | Stilwell, Jr. | 210/144 |
| 3,938,134 A | | 2/1976 | Hackstein et al. | 340/324 M |
| 4,411,664 A | | 10/1983 | Rickard et al. | 8/158 |
| 5,419,163 A | | 5/1995 | Kim et al. | 68/12.02 |
| 5,659,136 A | | 8/1997 | Koch et al. | 73/462 |
| 5,930,855 A | | 8/1999 | Vande Haar et al. | 8/159 |
| 5,970,555 A | | 10/1999 | Baek et al. | 8/159 |
| 6,134,926 A | * | 10/2000 | Vande Haar et al. | 68/12.06 |
| 6,425,450 B1 | * | 7/2002 | Lansberry | 180/9.36 |
| 6,510,715 B1 | * | 1/2003 | Simsek | 68/12.06 |

* cited by examiner

*Primary Examiner*—Randy Gulakowski
*Assistant Examiner*—Joseph L. Perrin
(74) *Attorney, Agent, or Firm*—Diederiks & Whitelaw, PLC

(57) ABSTRACT

An appliance is provided with a display system for use in connection with leveling the appliance. The system includes an accelerometer used in connection with an electronic controller to sense the degree to which the appliance is not level. Signals from the accelerometer are sent to a CPU which regulates a visual depiction on a display provided on the appliance. Adjustments made to alter the leveling condition of the appliance are also relayed to CPU, thereby updating the display and conveying when the appliance is suitably level. The system components can also be used to regulate other appliance operations.

18 Claims, 4 Drawing Sheets

APPLIANCE INCORPORATING LEVELING DISPLAY SYSTEM

BACKGROUND OF THE INVENTION

1. Field of the Invention

The present invention pertains to the art of appliances, and more particularly, to an appliance having a display system adapted to show a leveling condition of the appliance.

2. Discussion of the Prior Art

Various types of appliances are commonly placed in a wide range of environments, both in the business and domestic markets. For proper operation, many appliances must be supported in a level condition. However, when such appliances are installed, they are often supported on floors or foundations which are not perfectly flat or level. Nonetheless, it is critical that the appliance be mounted in a level and stable condition in order to function properly. This requirement can extend to a wide range of commonly known appliances, including clothes washing machines, clothes dryers, dishwashers and refrigerators.

For instance, the leveling and stabilizing of a washing machine are important in connection with the overall operation of the machine. A washing machine which is not level and stable will rock during operation and be more likely affected by unbalanced loads within the washing machine, particularly during an extraction cycle. Indeed, unlevel washing machines have been known to rock back and forth to the point that they "walk" across a laundry room floor. Such motion is intolerable and numerous proposed solutions to this problem have heretofore been presented.

Typically, appliances are provided with adjustable support feet which can be selectively extended or retracted. During installation, a technician can adjust each of the feet individually until the machine is level. Most often, such adjustments are made either by delivery personnel through merely visual inspection or, alternatively, the use of a carpenter's level. Obviously, the visual approach is not very accurate and requiring the installer to carry additional tools, such as a level, is also not desirable. In addition, even with the use of a level, various leg adjustment iterations are generally necessary, in combination with periodic shifting of the level, to achieve a final level condition.

Based on the above, there exists a need in the art of appliances for a system which can be used to readily convey a leveling condition of the appliance to an installer or user thereof. Specifically, there exists a need for a leveling system which is integrated into the appliance and incorporates a display that visually represents the level condition of the appliance.

SUMMARY OF THE INVENTION

An appliance constructed in accordance with the present invention incorporates a display system for visually representing a leveling condition of the appliance. Preferably, the leveling display system incorporates a two axis accelerometer used to determine if the machine is level and an LCD display which shows the information obtained from the accelerometer. In accordance with a preferred embodiment of the invention, the appliance includes a liquid crystal display (LCD) having a bubble icon represented on the LCD in relation to a number of concentric circles to convey the leveling condition of the appliance in both front to back and side to side directions. In practice, signals from the two axis accelerometer is sent to a controller of the appliance, whereupon the controller interprets the signals and appropriately alters the display.

In use, when installing an appliance, the installer enters a special control mode through the display such that the level icon arrangement is visually illustrated. Based on the graphic representation provided, the installer can readily determine which of various leveling legs of the appliance need to be adjusted. The installer can continue to adjust one or more of the legs, while getting constant feedback through the display, until a desired leveling condition is reached. After initial appliance installation, information from the same accelerometer can be advantageously used to convey whenever a subsequent unlevel condition, as well as other appliance conditions, arises. For instance, in the case of a clothes washing machine, an actual or incipient unbalance, a starving drain pump, or an excessive vibration condition can be sensed, with signals being relayed to the controller for suitably altering the operation of the machine and/or providing a visual warning to the user of the appliance.

Additional objects, features and advantages of the invention will become more readily apparent from the following detailed description of preferred embodiments of the invention, when taken in conjunction with the drawings wherein like reference numerals refer to corresponding parts in the several views.

DETAILED DESCRIPTION OF THE PREFERRED EMBODIMENTS

Figure 1:
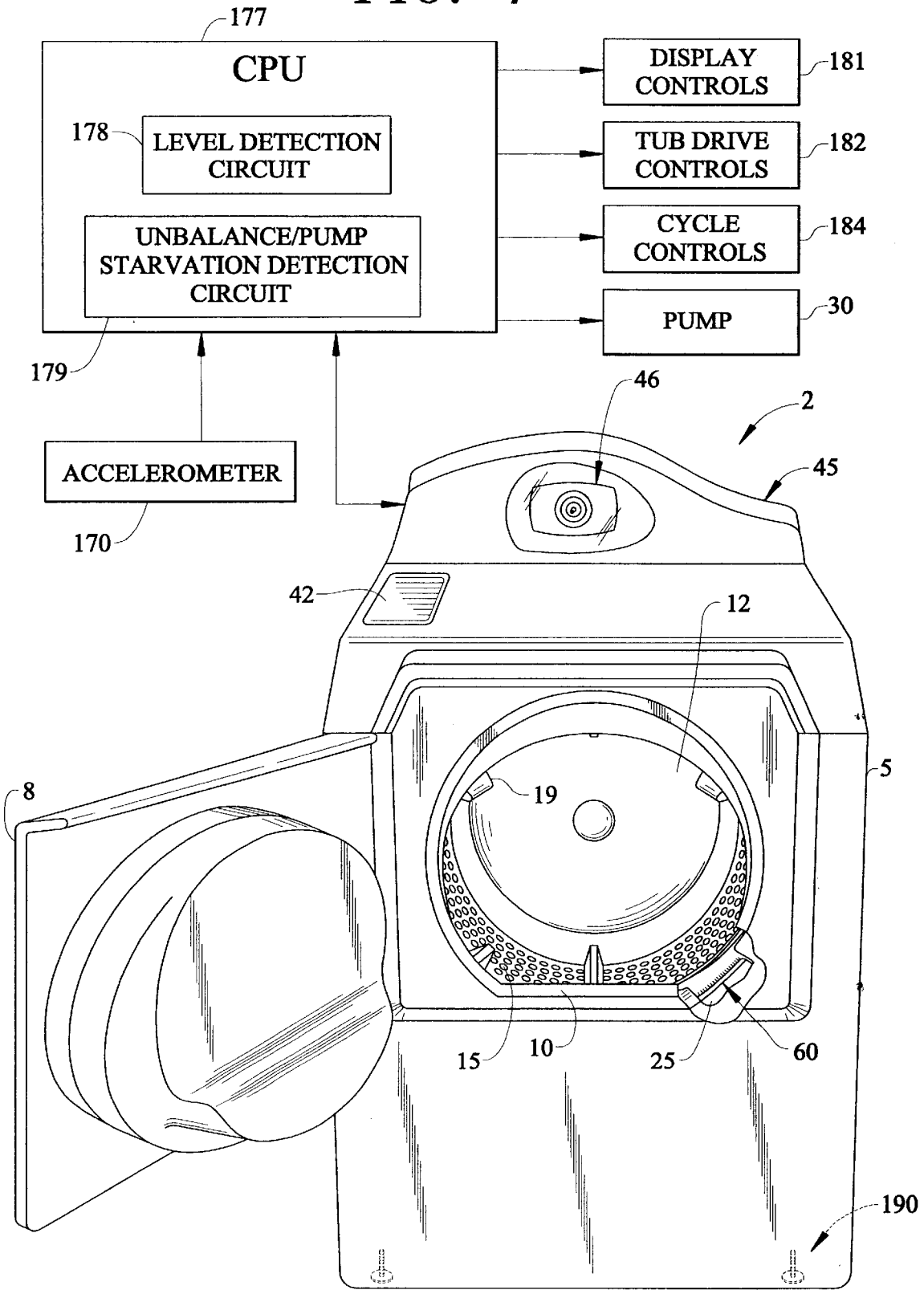
FIG. 1 is a partially cut away, perspective view of a washing machine incorporating a leveling display system constructed in accordance with the present invention.

For purposes of describing the invention, reference will be made to the application of the invention in a laundry appliance. However, as will become readily apparent below, the invention is applicable to a wide range of appliances. Therefore, with initial reference to FIG. 1, an automatic horizontal axis washing machine incorporating the display system of the present invention is generally indicated at 2. In a manner known in the art, washing machine 2 is adapted to be front loaded with articles of clothing to be laundered through a tumble-type washing operation. As shown, automatic washing machine 2 incorporates an outer cabinet shell 5 provided with a front door 8 adapted to extend across an access opening 10. Front door 8 can be selectively pivoted to provide access to an inner tub or spinner 12 that constitutes a washing basket within which the articles of clothing are laundered.

As is known in the art, inner tub 12 is formed with a plurality of holes 15 and multiple, radially inwardly projecting fins or blades 19 are fixedly secured to inner tub 12. Inner tub 12 is mounted for rotation within an outer tub 25, which is supported through a suspension mechanism (not shown) within cabinet shell 5. Inner tub 12 is mounted within cabinet shell 5 for rotation about a generally horizontal axis. Actually, the rotational axis is angled slightly downwardly and rearwardly as generally represented in FIG.

3. Although not shown, a motor, preferably constituted by a variable speed, reversible electric motor, is mounted within cabinet shell 5 and adapted to drive inner tub 12. More specifically, inner tub 12 is rotated during both wash and rinse cycles such that articles of clothing placed therein actually tumble through either water, water/detergent or another washing fluid supplied within inner tub 12. Given that inner tub 12 is provided with at least the plurality of holes 15, the water or water/detergent can flow between the inner and outer tubs 12 and 25. A pumping system (not shown) is provided to control the level of washing fluid within machine 2, with one pump 30, shown schematically in FIG. 3, particularly controlling the timed draining of the fluid from the outer tub 25.

The general manner in which the automatic washing machine 2 of FIG. 1 operates is well known in the art and is not considered an aspect of the present invention. Therefore, a full description of its operation will not be described here. However, for the sake of completeness, automatic washing machine 2 is also shown to include an upper cover 42 that provides access to an area for adding detergent, softeners and the like. In addition, an upper control panel 45, including an LCD display screen 46, is provided for manually establishing a desired washing operation in a manner known in the art.

Figure 2:
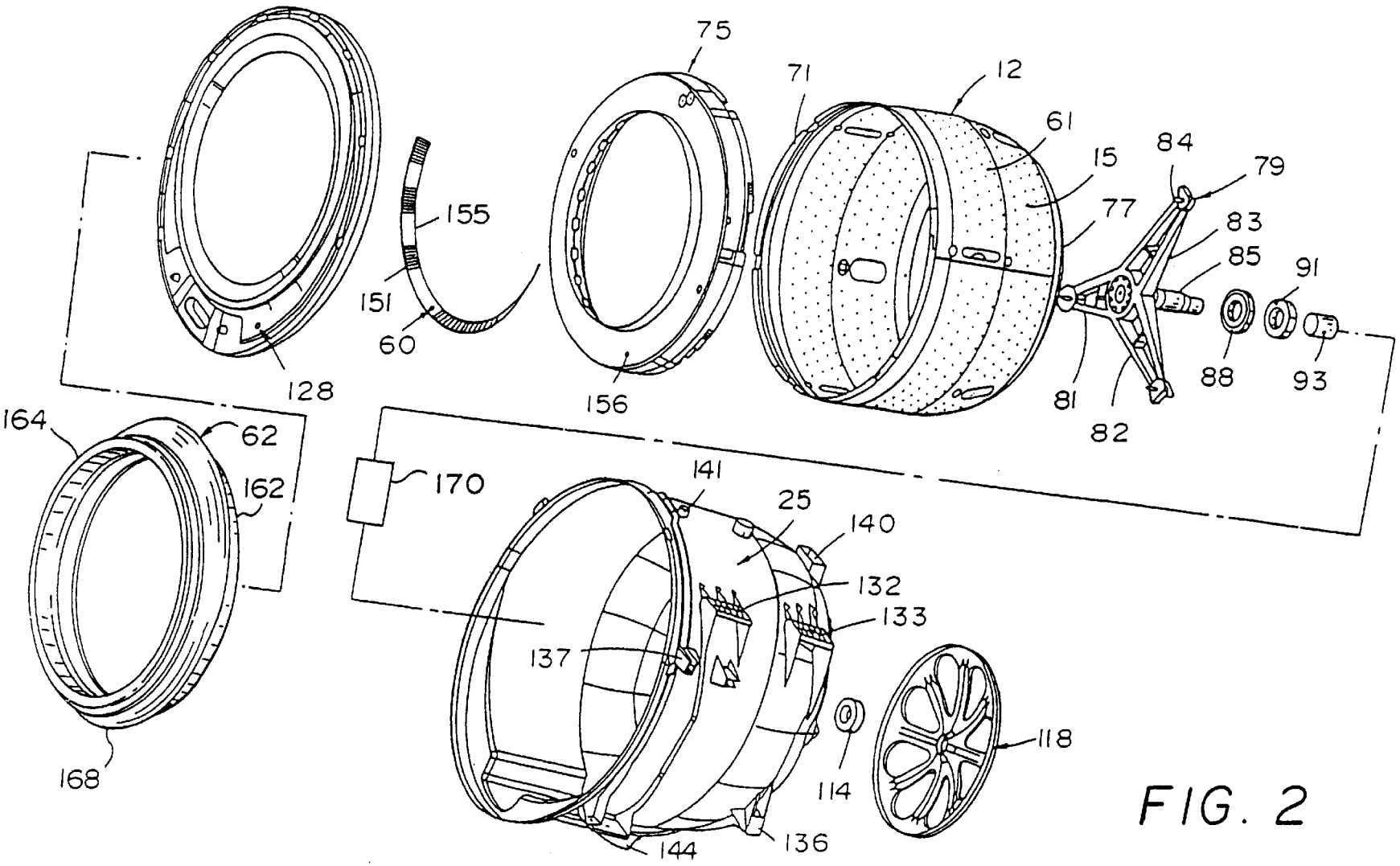
FIG. 2 is an exploded view of the various internal components of the washing machine of FIG. 1.
Figure 3:
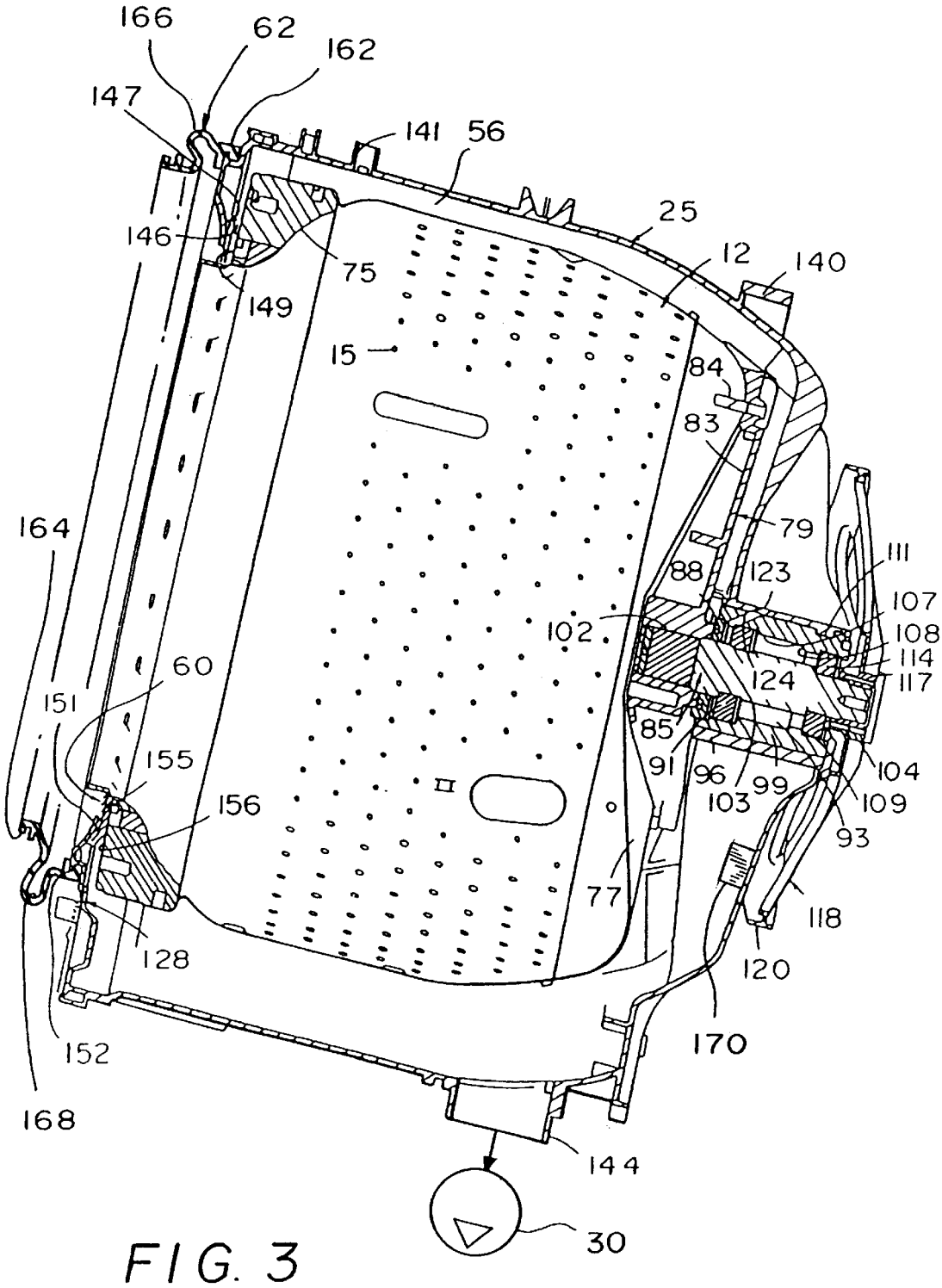
FIG. 3 is a cross-sectional view of the internal components of the washing machine of FIG. 2 in an assembled state.

As best seen in FIGS. 2 and 3, in order to allow inner tub 12 to freely rotate within outer tub 25 during a given washing operation, inner tub 12 is spaced concentrically within outer tub 25. This spacing establishes an annular gap 56 between the inner and outer tubs 12 and 25. As will be discussed fully below, an axial gap is also created at the open frontal portions of inner and outer tubs 12 and 25. During operation of washing machine 2, the washing fluid can flow through gap 56 from inner tub 12 into outer tub 25. In addition, small objects can also flow into the outer tub 25 through the axial gap. Unfortunately, it has been found in the past that some objects flowing through the axial gap can end up clogging or otherwise disrupting the normal operation of the pumping system, thereby leading to the need for machine repairs. In order to remedy this situation, it has been heretofore proposed to incorporate a flexible sealing device, generally indicated at 60 in FIGS. 1 and 3, which functions to bridge this gap between inner and outer tubs 12 and 25 to prevent such objects from flowing into the outer tub 25. Further provided as part of washing machine 2, in a manner known in the art, is a sealing boot 62 which extends generally between outer tub 25 and a frontal panel portion (not separately labeled) of cabinet shell 5.

Reference now will be made to FIGS. 2 and 3 in describing the preferred mounting of inner tub 12 within outer tub 25 and the arrangement of both sealing device 60 and sealing boot 62 as the tumble cycle feature of the present invention is related to the presence of one or more of these structural elements. Inner tub 12 has an annular side wall 61 and an open front rim 71 about which is secured a balance ring 75. In the preferred embodiment, balance ring 75 is injection molded from plastic, such as polypropylene, with the balance ring 75 being preferably mechanically attached to rim 71. Inner tub 12 also includes a rear wall 77 to which is fixedly secured a spinner support 79. More specifically, spinner support 79 includes a plurality of radially extending arms 81-83 which are fixedly secured to rear wall 77 by means of screws 84 or the like. Spinner support 79 has associated therewith a driveshaft 85. Placed upon driveshaft 85 is an annular lip seal 88. Next, a first bearing unit 91 is press-fit onto driveshaft 85. Thereafter a bearing spacer 93 is inserted upon driveshaft 85.

The mounting of inner tub 12 within outer tub 25 includes initially placing the assembly of inner tub 12, balance ring 75, spinner support 79, lip seal 88, first bearing unit 91 and bearing spacer 93 within outer tub 25 with driveshaft 85 projecting through a central sleeve 96 formed at the rear of outer tub 25. More specifically, a metal journal member 99 is arranged within central sleeve 96, with central sleeve 96 being preferably molded about journal member 99. Therefore, driveshaft 85 projects through journal member 99 and actually includes first, second and third diametric portions 102–104. In a similar manner, journal member 99 includes various diametric portions which define first, second and third shoulders 107–109. Journal member 99 also includes an outer recess 111 into which the plastic material used to form outer tub 25 flows to aid in integrally connecting journal member 99 with outer tub 25.

As best shown in FIG. 3, the positioning of driveshaft 85 in journal member 99 causes each of annular lip seal 88, first bearing 91 and bearing spacer 93 to be received within journal member 99. More specifically, annular lip seal 88 will be arranged between first diametric portion 102 of driveshaft 85 and journal member 99. First bearing unit 91 will be axially captured between the juncture of first and second diametric portions 102 and 103, as well as first shoulder 107. Bearing spacer 93 becomes axially positioned between first bearing unit 91 and second shoulder 108 of journal member 99. Thereafter, a second bearing unit 114 is placed about driveshaft 85 and inserted into journal member 99, preferably in a press-fit manner, with second bearing unit 114 being seated upon third shoulder 109. At this point, a hub 117 of a spinner pulley 118 is fixedly secured to a terminal end of driveshaft 85 and axially retains second bearing unit 114 in position. Spinner pulley 118 includes an outer peripheral surface 120 which is adapted to be connected to a belt (not shown) driven in a controlled fashion by the reversible motor mentioned above in order to rotate inner tub 12 during operation of washing machine 2. In order to provide lubrication to lip seal 88, central sleeve 96 is formed with a bore 123 that is aligned with a passageway 124 formed in journal member 99.

Outer tub 25 has associated therewith a tub cover 128. More specifically, once inner tub 12 is properly mounted within outer tub 25, tub cover 128 is fixedly secured about the open frontal zone of outer tub 25. Although the materials for the components discussed above may vary without departing from the spirit of the invention, outer tub 25, balance ring 75 and tub cover 128 are preferably molded from plastic, while inner tub 12 is preferably formed of stainless steel. Again, these materials can vary without departing from the spirit of the invention. For example, inner tub 12 could also be molded of plastic.

Outer tub 25 is best shown in FIG. 2 to include a plurality of balance weight mounting gusset platforms 132 and 133, a rear mounting boss 136 and a front mounting support 137. It should be realized that commensurate structure is provided on an opposing side portion of outer tub 25. In any event, balance weight mounting platforms 132 and 133, mounting boss 136, mounting support 137 and further mounting boss 140 are utilized in mounting outer tub 25 within cabinet shell 5 in a suspended fashion. Again, the specific manner in which outer tub 25 is mounted within cabinet shell 5 is not considered part of the present invention, so it will not be described further herein. Outer tub 25 is also provided with a fluid inlet port 141 through which washing fluid, i.e., either water, water/detergent or the like, can be delivered into outer tub 25 and, subsequently, into inner tub 12 in the manner discussed above.

Furthermore, outer tub 25 is formed with a drain port 144 which is adapted to be connected to the pump 26 for draining the washing fluid from within inner and outer tubs 12 and 25 during certain cycles of a washing operation.

As best illustrated in FIG. 3, inner tub 12 is entirely spaced from outer tub 25 for free rotation therein. This spaced relationship also exists at the front ends of inner and outer tubs 12 and 25 such that an annular gap 146 is defined between an open frontal zone 147 of outer tub 25 and an open frontal portion 149 associated with balance ring 75. It is through a lower section of gap 146 that washing fluid can also flow from within inner tub 12 to outer tub 25. With this fluid flow, other items including buttons, hair pins and the like inadvertently placed in inner tub 12 with the clothes to be washed, can get into outer tub 25. Typically, the pump 26 associated with drain port 144 is capable of managing certain objects without any problem. However, depending upon the size and number of the objects, the pump 26 may not be able to handle the objects, whereby the pump 26 will clog or at least the normal operation thereof will be disrupted.

Because of this problem, the flexible sealing device 60 is mounted so as to bridge gap 146 between inner and outer tubs 12 and 25 and, specifically, between balance ring 75 and tub cover 128. Gap 146 is required because of deflections between inner tub 12 and outer tub 25 during operation of washing machine 2. Sealing device 60 bridges gap 146 to prevent small items from passing through, but sealing device 60 is flexible so as to accommodate changes in the size of gap 146 resulting from deflections during operation. Sealing device 60 includes a first seal portion 151 that is fixed or otherwise secured to a rear or inner surface 152 of tub cover 128 and a second, flexible seal portion 155, such as brush bristles or a plastic film, which projects axially across gap 146 and is placed in close proximity and most preferably in sliding contact with a front or outer surface 156 of balance ring 75. As is also known in the art, sealing boot 62 includes an inner annular end 162 which is fixed sealed to tub cover 128, an outer annular end 164 which is fixed to the front cabinet panel (not separately labeled) of cabinet shell 5 and a central, flexible portion 166. As perhaps best shown in FIG. 3, flexible portion 166 actually defines a lower trough 168.

Until this point, the basic structure of washing machine 2 as described above is known in the art and has been described both for the sake of completeness and to establish the need and advantages of the leveling display system of the present invention which will be detailed below. The present leveling display system is shown as a modification to washing machine 2 having the LCD display 46. LCD display 46 can be used to operate washing machine 2 in accordance with the disclosure in copending U.S. patent application Ser. No. 09/741,067 filed Dec. 21, 2000 which is hereby incorporated by reference. In addition to the conventional parts of washing machine 2 as described above, the leveling display system includes an accelerometer 170 which may be mounted essentially anywhere within the washing machine 2.

Figure 4:
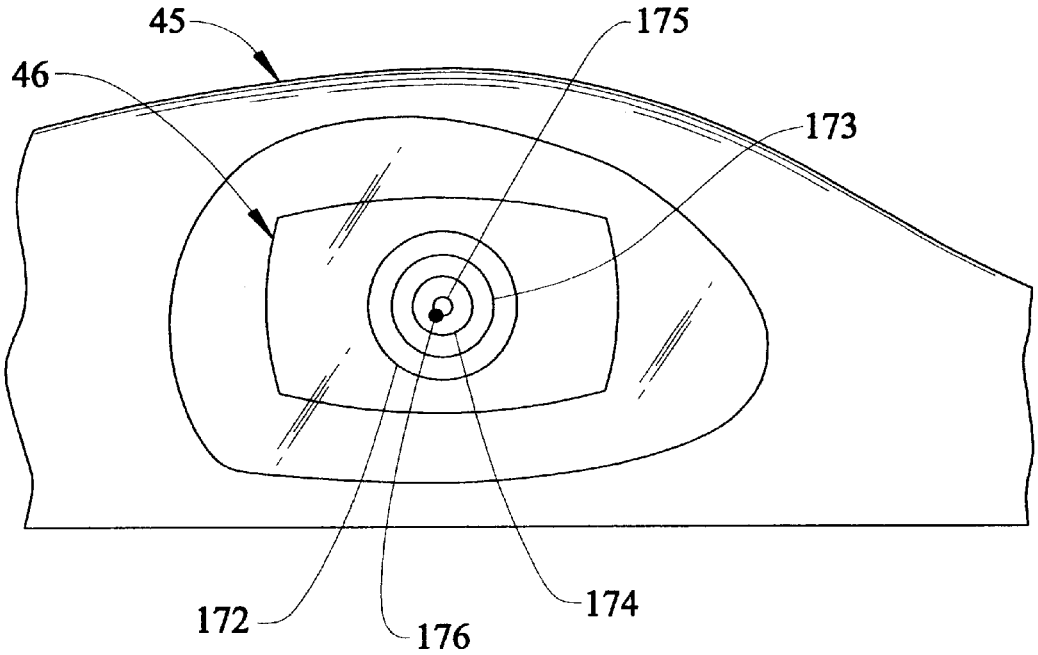
FIG. 4 is an enlarged view of the leveling display of FIG. 1.

As best represented in FIG. 4, display 46 is able to show a pattern, preferably in the form of a target icon, such as a bullseye, enabling a technician, installer or other user of washing machine 2 to discern whether or not the machine 2 is level, particularly when being installed. In the most preferred form of the invention, the pattern is represented by a series of concentric rings 172–175 as shown in FIG. 4, along with a moving dot 176 which essentially represents a "bubble" analogous to that found in a conventional liquid-type carpenter's level. Signals from accelerometer 170 are directed to a central processing unit (CPU) 177 incorporating specific circuits. More specifically, CPU 177 includes a level detection circuit 178 and an unbalance/pump starvation detection circuit 179, along with several controls such as a display controller 181, a tub drive controller 182, cycle controls 184 and a control for pump 30.

As shown in FIG. 3, accelerometer 170 is preferably mounted to a rear wall of outer tub 25 of washing machine 2. Accelerometer 170 is connected through a wire (not shown) to CPU 177. In general, accelerometer 170 is a two axis accelerometer which can measure the tilting of machine 2, either around a horizontal axis about which the tub 12 rotates or, alternatively, about an axis which is 90° relative thereto. Such an arrangement enables accelerometer 170 to determine whether washing machine 2 is tilted too far to the left or right, or front to back, as typically viewed from the front of machine 2 as seen in FIG. 1.

Central processing unit 177 receives signals from accelerometer 170 and interprets them in several ways. Primarily CPU 177 uses a level detection circuit 178 in order to determine the amount of tilting in the machine 2 in the various directions mentioned above. In a preferred embodiment, this information is interpreted and sent to display controller 181 so that display 46 shows the numerous concentric circles 172–175, along with dot 176 which may move relative to circles 172–175 to indicate how far machine 2 is off level. Ideally, when dot 176 aligns with the center of concentric circles 172–175, machine 2 is perfectly level.

In operation, a technician, installer or other user of washing machine 2 will select an icon initially represented in display 46 in order to have CPU 177 present the concentric circles 172–175 and bubble 176, as opposed to standard control options which are normally depicted. Thereafter, feet 190 located at the bottom of cabinet shell 5 of washing machine 2, as shown in FIG. 1, are manually adjusted until display 46 indicates that machine 2 is level. Of course, although only two manually adjustable feet 190, which are threadably attached to cabinet shell 5, are depicted, it should be clearly understood that a total of four feet 190, two in the front and two in the rear of cabinet shell 5, are preferably provided.

It should be noted that accelerometer 170 can be used for numerous other functions within washing machine 2 besides just feeding signals to CPU 177 to be processed through level detection circuit 178 and display controls 181. Rather, based on signals received by CPU 177 from accelerometer 170, unbalance/pump starvation detection circuit 179 can determine whether machine 2 is unbalanced or exhibits an excessive vibration. In accordance with the invention, the presence of an unbalance condition is counteracted by reducing the rate at which basket 12 is being driven through tub drive controls 182 and/or altering the preset operating cycles of washing machine 2 through cycle controls 184. For instance, if an unbalance condition is detected during the extraction phase of washing machine 2, the rotational speed imparted to basket 12 is preferably, initially reduced. If this alteration does not alleviate the excessive balance condition, the operating cycle of washing machine 2 is then terminated through cycle controls 184. Alternatively, cycle controls 184 can simply activate a visual or audible alarm so the user can take appropriate action.

Additionally, CPU 180 and, more specifically, unbalance/pump starvation circuit 179 can also detect characteristic electrical signals from accelerometer 170 which indicate when drain pump 30 is starving, for example during water spinout. While unbalance condition noises are typically caused by cabinet hits from rotating basket 12 and other general vibrations, a starving pump causes vibrations from lack of water and the forcing of water back and forth in a drain hose. In accordance with the invention, accelerometer 170 relays to CPU 177 vibration signals indicative of pump noises which are objectionably high and indicative of classic pump starving conditions. Once CPU 177 senses that accelerometer 170 is conveying characteristic signals of pump starvation through circuit 179, cycle controls 184 are preferably used to turn pump 30 off to avoid the pump starvation condition. Furthermore, when the water level is high enough to hit inner basket 12 and thus cause a characteristic vibration within washing machine 2, cycle controls 184 function to turn drain pump 30 on again.

Still further, accelerometer 170, provided for use in leveling washing machine 2 in accordance with the invention, may also be used to find optimum speeds that provide a relatively low amount of vibration in washing machine 2. A similar method of finding an optimal rotational speed for tub 12 to keep a washing machine vibration at a minimum can be found in U.S. Pat. No. 5,930,855 which is incorporated herein by reference.

Based on the above description, it is readily apparent that the present invention provides a simple and inexpensive leveling display system which provides a convenient and effective manner to level an appliance to enhance the operation thereof. Additionally, the preferred embodiment provides an efficient way to effect further control of an appliance economically using certain parts of the leveling display system. In any event, although described with reference to a preferred embodiment of the invention as incorporated in a washing machine, it should be understood that the invention can also be utilized in various other types of appliances, including clothes dryers, dishwashers and refrigerators, all of which would exhibit enhanced operating performance when level. For example, for proper operation, a refrigeration circuit needs to be properly leveled such that the leveling display system could be advantageously employed in a refrigerator. Corresponding advantages are achieved in clothes dryers and dishwashers as well. In any event, various changes and/or modifications can be made to the invention without departing from the spirit thereof. Finally, it should be realized that other known devices for sensing a leveling condition can be employed in place of accelerometer 170. Therefore, in general, the invention is only intended to be limited by the scope of the following claims.

I claim:

1. An appliance comprising:

a cabinet shell;

a device for sensing a leveling condition of the appliance;

an electronic controller connected to the sensing device; and a display integrated into the appliance and linked to the controller, said display being adapted to convey information regarding the leveling condition of said appliance.

2. The appliance according to claim 1, wherein a target icon is presented in the display.

3. The appliance according to claim 1, wherein said device constitutes an accelerometer mounted inside the cabinet shell, said display being altered by the controller based on signals from said accelerometer.

4. The appliance according to claim 3, wherein said accelerometer is a two axis accelerometer.

5. The appliance according to claim 4, wherein the accelerometer senses the leveling condition about two, substantially perpendicular axes.

6. The appliance according to claim 3, wherein said appliance constitutes a clothes washing machine.

7. The appliance according to claim 6, wherein said clothes washing machine includes an outer tub mounted within the cabinet shell and an inner tub mounted within the outer tub for rotation during predetermined intervals in an overall washing operation, wherein said accelerometer sends signals to said controller indicative of an operating condition of the appliance.

8. The appliance according to claim 7, wherein the operating condition constitutes an unbalance condition.

9. The appliance according to claim 7, further comprising: a drain pump, said operating condition constitutes a starvation condition for the drain pump.

10. The appliance according to claim 7, further comprising:

means for varying the rotational speed of the inner tub over a range of speeds; and means for determining a speed which develops an optimum level of vibration of the appliance based on signals received from the accelerometer.

11. A method of operating an appliance comprising:

sensing a leveling condition of the appliance; and conveying the leveling condition of the appliance through a display integrated into the appliance.

12. The method according to claim 11, further comprising: conveying the leveling condition by presenting a target icon in the display.

13. The method according to claim 11, further comprising:

sensing the leveling condition of the appliance through the use of an accelerometer.

14. The method according to claim 13, further comprising: sensing the leveling condition through the accelerometer about two axes.

15. The method according to claim 14, wherein the two axes are substantially perpendicular.

16. The method according to claim 13, further comprising:

sensing an unbalance operating condition of the appliance based on signals received from the accelerometer.

17. The method according to claim 13, further comprising:

varying a speed of rotation of a component of the appliance over a range of speeds;

developing vibration signals through the accelerometer over the range of speeds; and determine which speed make an optimum level of vibration.

18. The method according to claim 13, further comprising:

sensing a pump starvation condition in the appliance from signals received from the accelerometer.

* * * * *